United States Patent [19]

Margulies

[11] Patent Number: 4,985,626

[45] Date of Patent: Jan. 15, 1991

[54] QUADRUPOLE MASS FILTER FOR CHARGED PARTICLES

[75] Inventor: Marcel Margulies, Scarsdale, N.Y.

[73] Assignee: The Perkin-Elmer Corporation, Norwalk, Conn.

[21] Appl. No.: 462,245

[22] Filed: Jan. 9, 1990

[51] Int. Cl.[5] ..... H01J 49/42

[52] U.S. Cl. ..... 250/292; 250/290

[58] Field of Search ..... 250/292, 290

[56] References Cited

U.S. PATENT DOCUMENTS

| | | | |
|---|---|---|---|
| 2,939,952 | 6/1960 | Paul et al. | 250/292 |
| 3,129,327 | 4/1964 | Brubaker | 250/292 |
| 3,501,631 | 3/1970 | Arnold | 250/292 |
| 3,725,700 | 4/1973 | Turner | 250/292 |

OTHER PUBLICATIONS

Hua et al., Nuclear Instruments and Methods 167(1979) pp. 101–107.

Jiang, Vacuum Science and Technology 145 (1981) pp. 151–161.

*Primary Examiner*—Jack I. Berman

*Attorney, Agent, or Firm*—H. S. Ingham; E. T. Grimes

[57] ABSTRACT

A mass filter for charged particles includes a cylindrical conductive housing at ground potential and an array of linear conductors arranged in parallel in the housing and divided equally into four subarrays. The conductors of each subarray lie in one of four planes having a tubular arrangement with a square cross section on the longitudinal axis of the housing. The conductors have a substantially uniform distribution in the planes. A dedicated voltage is applied to each conductor in each subarray, the voltages being selected cooperatively and with the dimensions of the housing and the square cross section, such that a quadrupole type of electric field is generated within the tubular arrangement. Equations are disclosed for determining the voltages.

9 Claims, 1 Drawing Sheet

QUADRUPOLE MASS FILTER FOR CHARGED PARTICLES

This invention relates to mass filters for charged particles and particularly to quadrupole type mass filters.

BACKGROUND OF THE INVENTION

Various types of filters have been known for selectively filtering particle mass in mass spectrometers and similar instruments. One type of non-magnetic filter is a quadrupole filter.

A true quadrupole filter is disclosed in U.S. Pat. No. 2,939,952 (Paul et al). The filter comprises four parallel rods arranged symmetrically, the mutually facing surfaces of the rods having hyberbolic cross sectional profiles. Identical potentials (voltages) are applied to one pair of opposite rods, and negative potentials of the same magnitude are applied to the other pair. A cross section of a field profile within the filter has equipotential lines that are hyberbolic. The patent further teaches that appropriate time varying potentials may be applied to the rods such that, when an ion beam is projected axially through the filter, the filter is selective of ion particle mass.

Hyberbolic rods with suitable precision are expensive to fabricate. As further disclosed in the aforementioned patent, the hyperbolic rods may be replaced with circular rods centrally disposed inside a cylindrical housing that is maintained at zero potential relative to the potential on the rods. By an appropriate selection of relative dimensions a field profile approximating the hyberbolic one may be achieved.

Since it has been recognized that such an approximation results in inefficient filtering, various efforts have been made to add other electrodes near the rods to modify the field. Examples are disclosed in U.S. Pat. Nos. 3,129,327 (Brubaker) and 3,725,700 (Turner). These have met with only limited success in approaching a true quadrupole filter, and low cost accurate simulation of a true quadrupole filter has remained elusive.

Therefore objects of the invention are to provide a novel type of mass filter for charged particles, to provide such a filter for simulating a quadrupole type of electric field for filtering, to provide a relatively low cost quadrupole type of mass filter having improved precision, and to provide an improved quadrupole type of filter capable of simple adjustments for fine tuning.

SUMMARY OF THE INVENTION

The foregoing and other objects are achieved with a mass filter for charged particles, generally including a cylindrical conductive housing having a longitudinal axis and a radius R and being receptive of a base voltage. An array of linear conductors are arranged in parallel within the housing and are divided equally into four subarrays. The conductors of each subarray lie in a longitudinal surface such that four such surfaces have identical shape and are in a tubular arrangment with a four-fold symmetry having at least one characterizing dimension. The conductors of each subarray have a substantially uniform distribution and include a pair of terminal conductors bounding all other conductors of the subarray, the terminal conductors being disposed proximate corresponding terminal conductors of adjacent subarrays. A dedicated voltage is applied to each conductor in each subarray, the voltages being selected cooperatively with each other and the characterizing dimension such that a quadrupole type of electric field is generated within the tubular arrangement.

In a prefered embodiment, the conductors of each subarray lie in a plane so that four such planes are in a tubular arrangement with a square cross section on the longitudinal axis. Each plane has a centerline parallel to the conductors. The square cross section has four sides each with a dimension $2r_o$. The conductors of each subarray have a substantially uniform distribution and include a primary conductor positioned nearest the centerline and further include a pair of terminal conductors bounding all other conductors of the subarray, the terminal conductors being disposed proximate corresponding terminal conductors of adjacent subarrays. Each conductor in each subarray has a position defined by $r_i$ and $a_i$, where i is an integer designating a conductor from $i=1$ for the primary conductor to $i=N$ for each terminal conductor with N being the number of conductors in each half subarray. The parameter $r_i$ is radial distance from the axis, and $a_i$ is an angle with a positive value about the axis with reference to the centerline having an angle of zero.

A dedicated voltage $V_i$ is applied to each corresponding conductor relative to a voltage $V_l$ applied to the primary conductor in each subarray, so as to provide an electric field profile charateristic of a quadrupole filter. Each voltage $V_i$ is determined preferably according to the following equations:

$$\sum_{i=2}^{N} (V_i/V_1)\{(r_o/r_i)^{2(2k+1)} - (r_o r_i/R^2)^{2(2k+1)}\}\cos[2(2k+1)a_i] = -\{(r_o/r_1)^{2(2k+1)} - (r_o r_1/R^2)^{2(2k+1)}\}\cos[2(2k+1)a_1] \quad (k = 1, 2 \ldots N-1)$$

where the voltages for each subarray are the negative of the voltages for adjacent subarrays relative to the base voltage being taken as zero. The mass filter thereby provides an electric field profile characteristic of a quadrupole filter.

Advantageously, for the foregoing equation the number of conductors in each subarray is between 3 and 10. Alternatively the number of conductors in each subarray is greater than 20. In the latter case the parameters may be defined so that each conductor in a subarray has a position in a corresponding side defined by a coordinate $s_i$ defined as the distance of the corresponding conductor from a corresponding centerline. The above equation then may be approximated by the formula $$V_i/V_o = \{1-(s_i/r_o)^2\}/2$$

where $V_o$ is a selected reference voltage for the centerline. In either case, each voltage $V_i$ may be fine tuned so as to provide an electric field profile equal to that of a quadrupole filter.

DETAILED DESCRIPTION OF THE INVENTION

Figure 1:
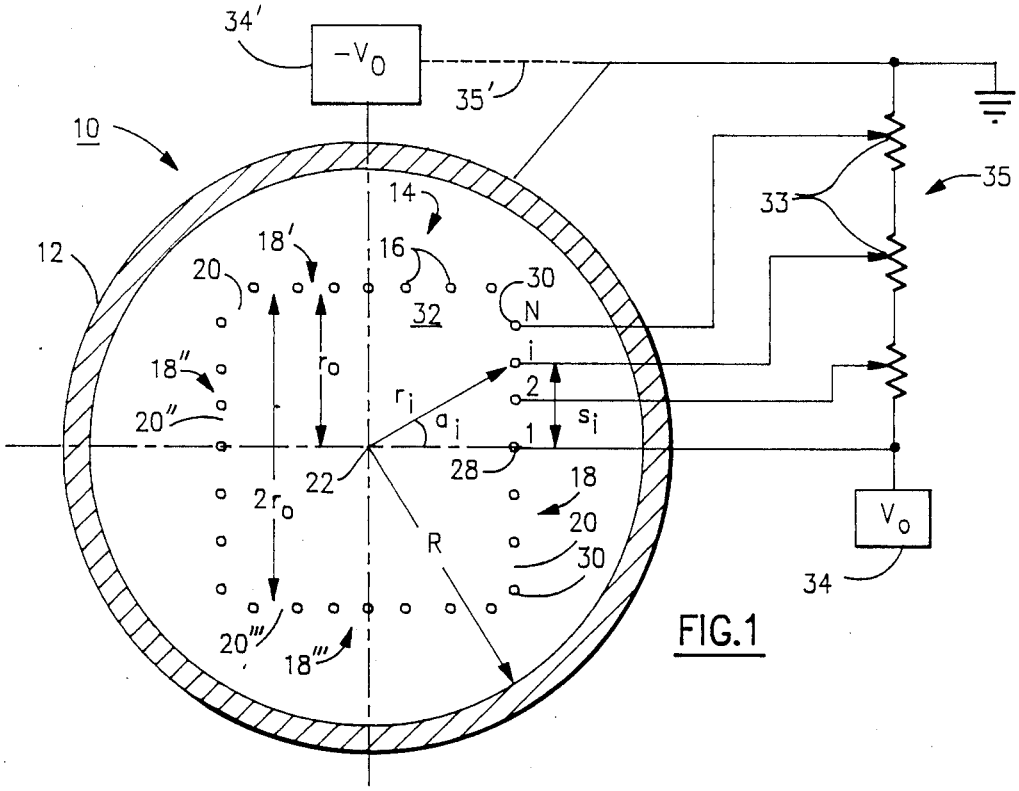
FIG. 1 is a schematic cross section of an arrangement of electrical conductors for a mass filter for charged particles, and an electrical schematic diagram of electrical connections for the conductors, according to the invention.

With reference to FIG. 1, a mass filter 10 includes a cylindrical housing 12 of radius R formed of an electrical conductor such as brass or aluminum or stainless steel. An array 14 of linear conductors 16 such as rigid wires of copper or the like is disposed longitudinally in the housing. The conductors are held firmly in place by any conventional means. The conductors are arranged in parallel and are divided equally into four subarrays 18,18',18'',18''' each consisting of a plurality of the conductors 16. The conductors of each subarray lie in a plane, 20,20',20'',20''' respectively, the four planes being positioned in a tubular arrangement with a square cross section centered on the longitudinal axis 22 of the housing 12. The square has a width or side dimension defined herein as $2r_o$, and each side has a midpoint 28.

The length of the housing and its array of conductors (perpendicular to the cross section of FIG. 1) is similar to that of a conventional hyberbolic or rod quadrupole filter, viz. at least 30 times the width $2r_o$ of the square cross section, preferably between about 50 and 100 times. The ends of the housing are closed, except for inlet and outlet ion channels for an input from an ion source and an output to a detector. The housing with the array of conductors is appropriately evacuated for free travel of ions.

The conductors 16 are spaced in each plane with a substantially uniform distribution, that is with generally equal spacing of nearest-neighbor conductors. The conductors should be spaced as uniformly as practical, although this is not highly critical as explained below. However, it is important that the conductors be precisely straight and parallel, and the conductors should be similar and preferably identical in configuration.

The conductors 16 are generally wire-like in the sense of having relatively small cross sectional dimensions relative to the side dimension $2r_o$ of the array. Thus the maximum cross sectional dimension of each conductor should be less than 10% of the dimension $2r_o$, preferably less than 5%.

Figure 2:
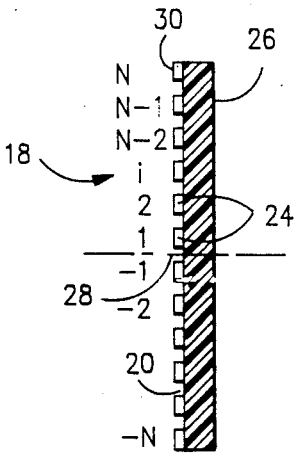
FIG. 2 is an embodiment for the conductors of FIG. 1.

If the conductors are wires they may be affixed to or laminated in insulating boards. Alternatively the conductors 16 may be in the form of narrow 24 strips of copper or gold or gold plated copper conventionally formed on a printed circuit board 26 as shown in FIG. 2. In this example the first conductors $i=1$ and $i=-1$ are off the centerline 28. Yet another form of array is produced by forming a conductive film such as aluminum on a glass plate, and cutting the conductors from the film with a ruling machine of the type used for producing diffraction gratings for a photospectrometer. In any case the linear conductors should have very small cross section relative to that of the array. The plates or boards containing the four subarrays are then affixed into the square cross section configuration. At least two of the plates or boards may extend to the cylindrical housing wall to retain the assembly, there being no conductors in the plates beyond the square.

Herein defined, there are N conductors in each half of each subarray. Therefore, either $2N-1$ or $2N$ conductors are in each subarray depending on whether or not a conductor lies on a longitudinal centerline (passing through midpoint 28) of the corresponding plane, i.e. whether there are an odd or even number of conductors. In the example of FIG. 1, $N=4$ so that there are seven conductors in the subarray, one being on the centerline and shared with both halves.

The position of each conductor in a subarray (e.g. subarray 18) has a position defined herein by $r_i$ and $a_i$, where i is an integer designating a conductor, from $i=1$ for the conductor nearest or on the centerline 28 in the plane 20 of the subarray, to $i=N$ for the terminal conductor 30. Coordinate $r_i$ is the radial distance from the axis of the array; and $a_i$ is an angle with a positive value about the axis with reference to the centerline having an angle of zero and cordinate $r_o$. The terminal conductors 30 are those pairs of conductors in each subarray that bound all other conductors in the subarray, and are disposed proximate corresponding terminal conductors of adjacent subarrays. Adjacent terminal conductors should not be spaced significantly more than about the spacing of adjacent conductors in a subarray. Also, adjacent terminal conductors should not coincide.

With further reference to FIG. 1 each conductor in each quadrant 32 of the array 10 has a separate electrical connection to a dedicated voltage source or tap 33 in a voltage divider 35 associated with the specific conductor. The divider may be resistive as shown, or may be capacitive for RF voltages. Each dedicated voltage $V_i$ associated with a conductor i is advantageously derived from a central voltage source 34 by means of a voltage divider (as shown) or the like taken from a centerline voltage $V_o$. If conductor $i=1$ is on the centerline (as shown in FIG. 1), then $V_l=V_o$. An identical but negative voltage $-V_o$ from a source 34' is provided for the portion of subarray 18' that is in quadrant 32. A similar voltage divider 35' or the like is also provided, and the pattern is repeated for the other quadrants.

Figure 3:
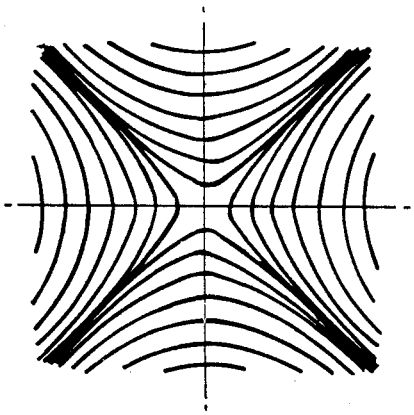
FIG.3 is a cross section of an electric field produced by the conductors of FIG. 1.

Each voltage $V_i$ is selected relative to a reference voltage such as $V_l$ for the conductor $i=1$, and the dimensions R and $r_o$ are also selected in cooperation therewith, such that a hyberbolic electric field profile of the type shown in FIG. 3 is effected within the array. These voltages are relative to a base voltage, the housing being at zero (usually ground) potential, and the symmetrically positioned conductors of adjacent subarrays have voltages of opposite polarity. The housing may alternatively have a floating base voltage other than ground, adapting to other component voltages in a system.

According to the invention the relative voltages and dimensions are preferably determined by a solution to the following set of primary equations:

$$\sum_{i=2}^{N} (V_i/V_1)\,\{(r_o/r_i)^{2(2k+1)} - (r_o r_i/R^2)^{2(2k+1)}\}\cos[2(2k+1)a_i] = -\{(r_o/r_1)^{2(2k+1)} - (r_o r_1/R^2)^{2(2k+1)}\}\cos[2(2k+1)a_1]\quad (k = 1, 2 \ldots N-1)$$

These equations do not have a simple solution but may be solved by computer using a conventional method such as the Gauss elimination matrix inversion method. An example of a set of voltages and dimensions derived from these equations is set forth in the Table.

TABLE

| | R = 25 mm, $r_o$ = 2.5 mm | |
|---|---|---|
| i | $a_i$ | $V_i/V_1$ |
| 1 | 0 degrees | 1.0000 |
| 2 | 8.5 | 1.0140 |
| 3 | 17 | 1.0555 |
| 4 | 25.5 | 1.1185 |
| 5 | 34 | 1.1703 |

TABLE-continued

| | R = 25 mm, $r_o$ = 2.5 mm | |
|---|---|---|
| i | $a_i$ | $V_i/V_1$ |
| 6 | 42.5 | 1.0460 |

The field will be quite close to being the hyperbolic field of FIG. 3, especially near the axis of the array, even for a relatively low number of conductors. For example for N=4 and a distance from the axis 22 less than $r_o/2$ the relative deviation from the perfect field will be of the order of $0.5^{(2*2N)}/(2N+1)$, i.e. about $2\times10^{-6}$. The number of conductors in each subarray should be at least three (N=2) but, for voltages determined by solving the above equations, the number need not be more than about 10 (N=5).

Alternatively a large number of conductors may be used, preferably more than 20, for example 50. In this case the above primary equations will be approximated by the simple formula:

$$V_i/V_o=\{1-(s_i/r_o)^2\}/2$$

where $s_i$ is the distance of conductor i in the relevant plane from the centerline, and $V_o$ is a selected reference voltage for which, in the case of a conductor i=1 being on the centerline of the plane of a subarray, $V_o=V_l$. This formula does not contain the parameter R for the radius of the housing, since the dimension of an electrically conductive housing becomes unimportant for a large number of closely spaced conductors. The housing (or equivalent) merely provides the zero (ground) potential relative to the voltages on the array.

The voltages $V_i$ are actually time varying in the usual or desired manner of voltages applied to a quadrupole filter as taught, for example, in the aforementioned U.S. Pat. No. 2,939,952. These voltages generally have a DC component and a sinusoidal (RF) component, and are generated by or via the central voltage source. The reference voltage $V_o$ or $V_l$ of the present invention correlates with the voltage applied (with alternating polarities) to the four rods of that patent, the voltages to the other conductors being proportioned according to the equations or formula herein, and fine tuned as desired.

In practice, because of construction limitations, it is probable that the conductors will not be mounted perfectly and the locations will deviate from those used in solving the above primary equations or simple formula. Therefore, the voltage ratios are applied nominally according to the equations or formula, and then may be fine tuned away from the equation calculations as necessary or desired to compensate for any dimensional changes or inaccuracies. The goal is to maximize sensitivity and/or resolution of the filter, or to reduce a particular perturbation in the field. Such tuning would ordinarily be done only upon manufacture, but alternatively may be left to the user for special requirements such as selection between maximum sensitivity and resolution, or for refinement in specified ranges of particle mass. The fine tuning may be effected with a conventional adjustment means such as by making the voltage divider system from variable resistance potentiometers (FIG. 1).

Although described in detail herein for the conductors being arranged in a square cross section, other configurations for the linear conductors may be convenient. For example the tubular arrangement of conductors may have a circular cross section in which case each subarray is in a quadrant of a circular cylinder, and the voltages are selected cooperatively with the radius of the cylinder. Broadly stated, the conductors of each subarray lie in a longitudinal surface (e.g. a plane or a cylinder quadrant) such that four such surfaces have identical shape. The surfaces with identical shape are in a tubular arrangement with a four-fold symmetry having at least one characterizing dimensions, e.g. side dimension of a square cross section, or radius of a cylinder. A more complex section may require a further characterizing dimension. In each case a dedicated voltage is applied to each conductor according to the principles set forth herein. Equations for the voltages may be derived from the more general equation for the potential V for a quadrupole field: $V=\frac{1}{2}V_o(X^2-Y^2)/r_o^2$ where X and Y are the horizontal and vertical coordinates of a cross section.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A mass filter for charged particles, comprising:

a cylindrical conductive housing having a longitudinal axis and a radius R, the housing being receptive of a base voltage;

an array of linear conductors arranged in parallel within the housing and divided equally into four subarrays, the conductors of each subarray lying in a plane so that four such planes are in a tubular arrangement with a square cross section centered perpendicular to the longitudinal axis, each plane having a centerline parallel to the conductors, the square cross section having four sides each with a dimension of $2r_o$, the conductors of ech subarray having a substantially uniform distribution and including a primary conductor positioned nearest or on the centerline and further including a pair of terminal conductors bounding all other conductors of the subarray, the terminal conductors being disposed proximate corresponding terminal conductors of adjacent subarrays, and each conductor in each subarray having a position defined by $r_i$ and $a_i$, where i is an integer designating a conductor from i=1 for the primary conductor to i=N for each terminal conductor with N being the number of conductors in each half subarray, $r_i$ is radial distance from the axis, and $a_i$ is an angle with a positive value about the axis with reference to the centerline having an angle of zero; and voltage means for applying a dedicated voltage $V_i$ to each corresponding conductor in each subarray relative to a voltage $V_l$ applied to the primary conductor, nominally according to the following equations:

$$\sum_{i=2}^{N}(V_i/V_1)\{(r_o/r_i)^{2(2k+1)}-(r_or_i/R^2)^{2(2k+1)}\}\cos[2(2k+1)a_i]=-\{(r_o/r_1)^{2(2k+1)}-(r_or_1/R^2)^{2(2k+1)}\}\cos[2(2k+1)a_1]\ (k=1,2\ldots N-1)$$

where the voltages for each subarray are the negative of the voltages for adjacent subarrays and are relative to the base voltage being taken as zero;

whereby the mass filter provides an electric field profile generally characteristic of a quadrupole filter.

2. A mass filter according to claim 1 further comprising adjustment means for fine tuning each voltage $V_i$ so as to provide an electric field profile equal to that of a quadrupole filter.

3. A mass filter according to claim 1 wherein the number of conductors in each subarray is between 3 and 10.

4. A mass filter according to claim 1 wherein the number of conductors in each subarray is greater than 20.

5. A mass filter according to claim 1 wherein the conductors are in the form of wires.

6. A mass filter according to claim 1 wherein the conductors are in the form of conductive strips on a circuit board.

7. A mass filter for charged particles, comprising:

an array of linear conductors arranged in parallel and divided equally into four subarrays, the conductors of each subarray lying in a plane so that four such planes are in a tubular arrangement with a square cross section, each plane having a centerline parallel to the conductors, the square cross section having four sides each with a dimension of $2r_o$, the conductors of each subarray having a substantially uniform distribution and including a pair of terminal conductors bounding all other conductors of the subarray, the terminal conductors being disposed proximate corresponding terminal conductors of adjacent subarrays, and each conductor in each subarray having a coordinate position $s_i$ in a corresponding side defined as the distance of the corresponding conductor from a corresponding centerline; and voltage means for applying a dedicated voltage $V_i$ to each corresponding conductor in each subarray relative to a selected reference voltage $V_o$ nominally according to the formula $$V_i/V_o=\{1-(s_i/r_o)^2\}/2$$

where the voltages for each subarray are the negative of the voltages for adjacent subarrays;

whereby the mass filter provides an electric field profile generally characteristic of a quadrupole filter.

8. A mass filter according to claim 7 wherein the conductors are in the form of wires.

9. A mass filter according to claim 7 wherein the conductors are in the form of conductive strips on a circuit board.

* * * * *